US007719398B2

(12) United States Patent
Tsuzuki

(10) Patent No.: US 7,719,398 B2
(45) Date of Patent: May 18, 2010

(54) LAMINATED COIL

(75) Inventor: Keniichi Tsuzuki, Higashiomi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 1003 days.

(21) Appl. No.: 10/596,632

(22) PCT Filed: Dec. 27, 2005

(86) PCT No.: PCT/JP2005/023908

§ 371 (c)(1),
(2), (4) Date: Jun. 19, 2006

(87) PCT Pub. No.: WO2006/073092

PCT Pub. Date: Jul. 13, 2006

(65) Prior Publication Data

US 2009/0184794 A1 Jul. 23, 2009

(30) Foreign Application Priority Data

Jan. 7, 2005 (JP) ..... 2005-003180

(51) Int. Cl.
*H01F 5/00* (2006.01)

(52) U.S. Cl. ..... 336/200; 336/232; 336/223

(58) Field of Classification Search ..... 336/200, 336/223, 232

See application file for complete search history.

(56) References Cited

U.S. PATENT DOCUMENTS

| | | | |
|---|---|---|---|
| 6,515,568 | B1 | 2/2003 | Maki et al. |
| 2002/0092599 | A1 | 7/2002 | Tokuda et al. |

FOREIGN PATENT DOCUMENTS

| | | | | |
|---|---|---|---|---|
| JP | 01-035483 | B2 | | 7/1989 |
| JP | 05036532 | A | * | 2/1993 |
| JP | 9-7835 | A | | 1/1997 |
| JP | 11-097243 | A | | 4/1999 |
| JP | 2001-044037 | A | | 2/2001 |
| JP | 2003-92214 | A | | 3/2003 |

OTHER PUBLICATIONS

International Search Report issued in Japanese International Application No. PCT/JP2005/023908, mailed Feb. 21, 2006.
Official communication issued in the counterpart European Application No. 05822354.6, mailed on Jul. 20, 2007.

* cited by examiner

*Primary Examiner*—Anh T Mai
(74) *Attorney, Agent, or Firm*—Keating & Bennett, LLP

(57) ABSTRACT

A laminated coil includes a laminated body having magnetic body sections that are provided on both main surfaces of a non-magnetic body section and include a plurality of stacked magnetic layers, the non-magnetic body section including at least one non-magnetic layer, and a coil including helically connected coil conductors provided in the laminated body. The conductor width of at least one of the coil conductors provided inside the non-magnetic body sections and the coil conductors provided on both main surfaces of the non-magnetic body sections is greater than the conductor width of the other coil conductors in the laminated body.

14 Claims, 4 Drawing Sheets

LAMINATED COIL

BACKGROUND OF THE INVENTION

1. Field of the Invention

The present invention relates to a laminated coil and, more specifically, to an open magnetic path type laminated coil having an excellent direct current (DC) superposition characteristic.

2. Description of the Related Art

An open magnetic path type laminated coil has been proposed as a known laminated coil in order to prevent a sudden decrease in the inductance value due to magnetic saturation inside a magnetic body. As described in Japanese Examined Patent Application Publication No. 1-35483, an open magnetic path type laminated coil includes a non-magnetic layer provided inside a laminated coil including magnetic layers. According to the structure of the open magnetic path type laminated coil, magnetic flux leaks from portions in the magnetic layers to the outside of the laminated coil, making it difficult for magnetic saturation to occur inside the magnetic body. As a result, reduction in inductance caused by a direct current is reduced, and the DC superposition characteristic is improved.

Although the open magnetic path type laminated coil according to Japanese Examined Patent Application Publication No. 1-35483 has an excellent DC superposition characteristic, there is a problem in that the inductance characteristic is unsatisfactory. In other words, since the non-magnetic layer is disposed at a location along the path of magnetic flux, the magnetic flux is blocked, causing a reduction in inductance. To obtain the desired inductance, the inductance may be increased by increasing the number of coil turns. However, an increase in the number of coil turns causes the direct current resistance to be significantly increased.

SUMMARY OF THE INVENTION

To overcome the problems described above, preferred embodiments of the present invention provide a laminated coil that has an excellent DC superposition characteristic and that is capable of preventing the reduction of inductance while reducing the direct current resistance.

A laminated coil according to a preferred embodiment of the present invention includes a laminated body including magnetic body sections provided on both main surfaces of a non-magnetic body section, the magnetic body sections including a plurality of stacked magnetic layers, the non-magnetic body section including at least one layer of a non-magnetic layer, and a coil including coil conductors provided in the laminated body, the coil conductors being helically connected, wherein the conductor width of at least one of the coil conductors provided inside the non-magnetic body sections and the coil conductors provided on both main surfaces of the non-magnetic body sections of the coil conductors provided in the laminated body is greater than the conductor width of the other coil conductors.

Since the conductor width of at least one of the coil conductors provided inside the non-magnetic body sections and the coil conductors provided on both main surfaces of the non-magnetic body sections is greater than the conductor width of the other coil conductors, the direct current resistance is reduced. Since coil conductors having a greater conductor width are provided inside the non-magnetic body sections and/or on both main surfaces, reduction in inductance is suppressed even when the conductor width of the coil conductors is increased.

More specifically, in general, if the conductor width of the coil conductors is increased, magnetic flux of the coil is blocked by the coil conductors having a greater conductor width and the inner circumference of the coil is reduced such that the amount of magnetic flux of the coil is reduced. Therefore, inductance is reduced. However, even if the conductor width of the coil conductors of the non-magnetic body section is increased, the amount of magnetic flux of the coil blocked by increasing the conductor width of the coil conductors is sufficiently small because the magnetic flux of the coil is blocked by the non-magnetic body section from the beginning. Furthermore, even if the conductor width of the coil conductors is increased, the reduction in the amount of magnetic flux transmitted is small compared with the reduction in the inner circumference of the coil at the magnetic body sections transmitting the magnetic flux because the inner circumference of the coil at the non-magnetic body section that blocks the magnetic fluxes is reduced. Thus, the reduction in the induction of the entire coil is reduced.

According to preferred embodiments of the present invention, the conductor width of the coil conductors provided inside the non-magnetic body sections and the coil conductors provided on both main surfaces of the non-magnetic body sections are greater than the conductor width of the other coil conductors. By increasing the conductor width of the coil conductors provided inside the non-magnetic body sections and the coil conductors provided on both main surfaces of the non-magnetic body sections, a plurality of coil conductors having an increased conductor width is provided. Thus, the direct current resistance is significantly reduced.

The conductor width of the coil conductors having a great conductor width is preferably about 1.05 to about 2.14 times the conductor width of the other coil conductors. In this manner, a coil of which reduction in inductance is suppressed as much as possible and whose direct current resistance is significantly reduced is obtained.

A plurality of the non-magnetic body sections may be provided inside the laminated body. By providing a plurality of the non-magnetic body sections inside the laminated body, the amount of magnetic flux leaking from the non-magnetic body section to the outside of the laminated coil is further increased. Thus, the DC superposition characteristic is further improved.

According to preferred embodiments of the present invention, a laminated coil having an excellent DC superposition characteristic and being capable of preventing the reduction of inductance while reducing the direct current resistance is provided, because the conductor width of the coil conductors provided inside the non-magnetic body sections and the coil conductors provided on both main surfaces of the non-magnetic body sections is greater than the conductor width of the other coil conductors.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Preferred embodiments of a laminated coil according to the present invention will be described below with reference to the drawings.

First Preferred Embodiment

Figure 1:
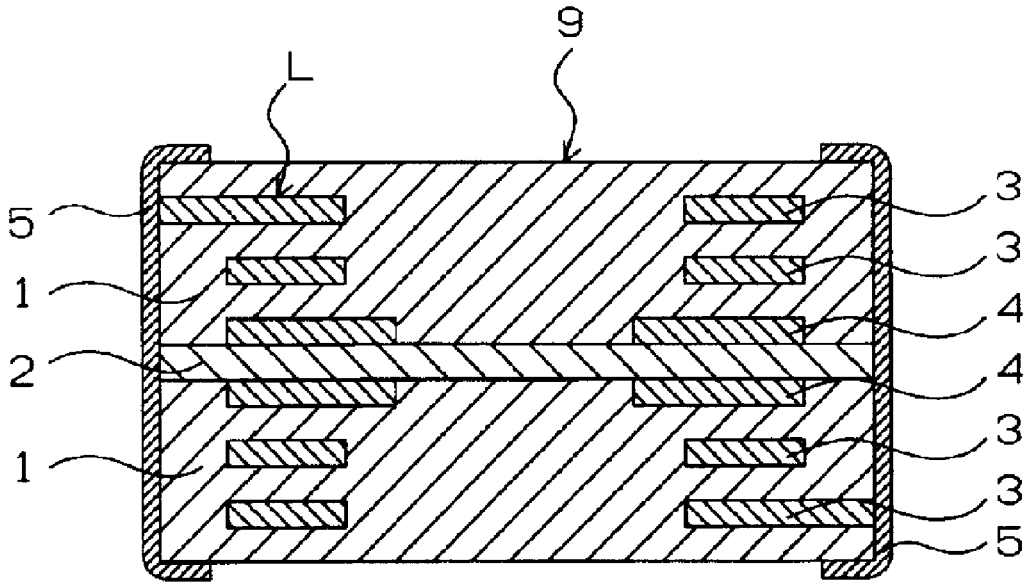
FIG. 1 is a schematic cross-sectional view of a laminated coil according to a first preferred embodiment of the present invention.

FIG. 1 is a schematic cross-sectional view of a laminated coil according to a first preferred embodiment of the present invention. The laminated coil includes a laminated body 9 having magnetic body sections 1 and a non-magnetic body section 2, a coil L including helically connected coil conductors 3 and 4 provided on the laminated body 9, and external electrodes 5. The magnetic body sections 1 are provided on both main surfaces of the non-magnetic body section 2. The magnetic body sections 1 each include a plurality of magnetic layers, and the non-magnetic body section 2 includes one non-magnetic layer.

As shown in FIG. 1, the coil conductors 4 are provided on both main surface of the non-magnetic body section 2. The conductor width of the coil conductors 4 is greater than that of the other coil conductors 3 having a predetermined conductor width. Since the conductor width of the coil conductor 4 is increased, the direct current resistance of the laminated coil is reduced.

Since the coil conductors 4 each having an increased conductor width are provided on both main surfaces of the non-magnetic body section 2, reduction in inductance is suppressed. More specifically, in general, if the conductor width of the coil conductors is increased, inductance is reduced because the amount of transmitted magnetic flux of the coil is reduced by being blocked by the coil conductors having an increased conductor width and by reducing the inner circumference of the coil. However, according to the first preferred embodiment, since the magnetic flux of the coil L is blocked by the non-magnetic body section 2 from the beginning, the amount of magnetic flux of the coil L that are blocked is significantly reduced by increasing the conductor width of the coil conductors 4 on both main surfaces of the non-magnetic body section 2. Even if the conductor width of the coil conductors 4 is increased, the inner circumference of the coil L in the non-magnetic body section 2 blocking the magnetic flux is reduced. Therefore, the reduction in the amount of the transmitted magnetic flux is small compared to the reduction in the inner circumference of the coil L in the magnetic body sections 1 transmitting the magnetic flux. In this manner, the reduction in induction of the entire coil L is significantly reduced.

Figure 2:
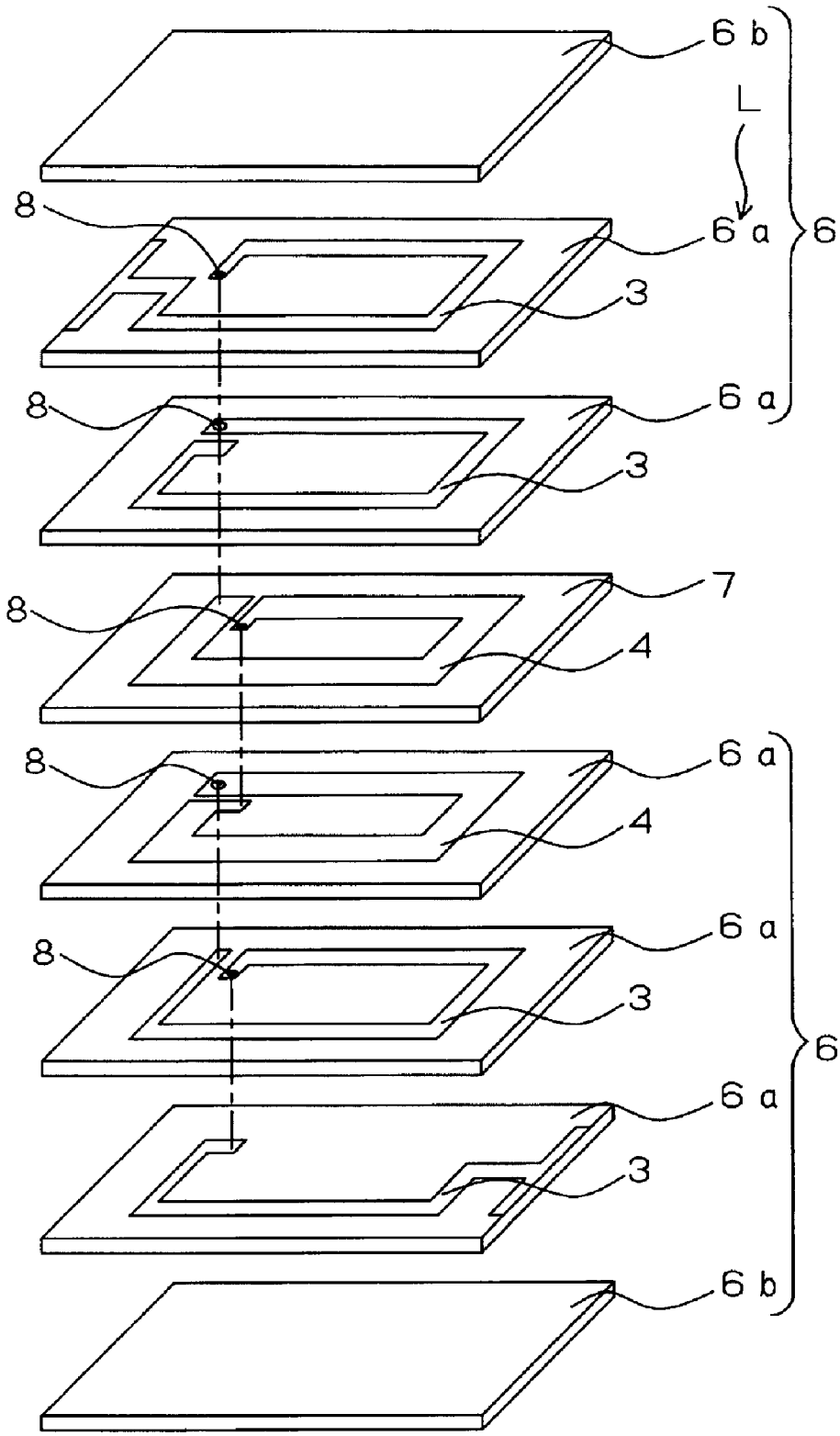
FIG. 2 is an exploded perspective view of a laminated coil according to the first preferred embodiment of the present invention.

Next, a method of producing the laminated coil according to the first preferred embodiment is described with reference to an exploded perspective view of a laminated coil illustrated in FIG. 2.

In the method of producing a laminated coil, first, green sheets 6 including a magnetic material and a green sheet 7 including a non-magnetic material are produced. After forming the laminated coil, the magnetic green sheets are referred to as magnetic layers and the non-magnetic green sheet is referred to as a non-magnetic layer.

According to the first preferred embodiment, a Ni—Cu—Zn based material is used as a magnetic material. First, a raw material including about 48.0 mol % of ferric oxide ($Fe_2O_3$), about 20.0 mol % of zinc oxide (ZnO), about 23.0 mol % of nickel oxide (NiO), and about 9 mol % of copper oxide (CuO) is wet prepared using a ball mill. The obtained mixture is dried and ground. The obtained powder is calcinated at about 750° C. for about one hour. The obtained powder is mixed with a binder resin, a plasticizer, a moistening agent, and a dispersant by a ball mill. Then, defoaming is performed to obtain slurry. The slurry is applied onto a peelable film. Then, by drying, the magnetic green sheet 6 that has a predetermined thickness is produced.

As a non-magnetic material, a Cu—Zn based material is preferably used. The non-magnetic green sheet 7 is produced of a raw material including about 48.0 mol % of $Fe_2O_3$, about 43.0 mol % of ZnO, and about 9.0 mol % of copper oxide (CuO) and preferably by using the same method as that of the above-described magnetic material. The relative magnetic permeability of a green sheet is about 130 for the magnetic green sheet 6 and about 1 for the non-magnetic green sheet 7.

Next, the green sheets 6 and 7 obtained as described above are cut into predetermined sizes. After stacking the green sheets 6 and 7, through-holes are formed at predetermined locations by a laser method such that the helical coil L is formed. Then, the coil conductors 3 and 4 are formed by applying conductive paste primarily including silver or a silver alloy onto magnetic green sheets 6*a* and the non-magnetic green sheet 7 by a screen printing method. By filling the inside of the through-holes with the conductive paste simultaneously to the production of the coil conductors 3 and 4, via-hole connection conductors 8 are easily formed.

Here, the coil conductors 4 having an increased width are formed on both main surfaces of the non-magnetic green sheet 7. According to the first preferred embodiment, the coil conductors 4 having an increased width are produced such that the conductor width is about 550 μm and the other coil conductors 3 are produced such that the conductor width is about 350 μm after calcination. By forming the coil conductors 4 having an increased width on both main surfaces of the non-magnetic green sheet 7, a laminated coil capable of suppressing the reduction in inductance and reducing direct current resistance is obtained.

Subsequently, the laminated body is produced by stacking the magnetic green sheets 6*a* having the coil conductors 3 on both main surfaces of the non-magnetic green sheet 7 and by disposing exterior magnetic green sheets 6*b*, not having coil conductors on the top and bottom. At this time, by stacking the non-magnetic green sheet 7 at a location substantially in the middle along the axial center direction of the helical coil L, the amount of magnetic flux leaking outside the laminated coil is increased. Thus, the DC superposition characteristic is improved.

Then, the laminated body is pressure bonded at about 45° C. at a pressure of about 1.0 t/cm$^2$ and cut into pieces of 3.2×2.5×0.8 mm by a dicer or a guillotine cutter to obtain unfired bodies of the laminated coil. Subsequently, binder removal and firing of the unfired bodies are performed. For binder removal, the unfired bodies are fired in a low oxygen atmosphere at about 500° C. for about 2 hours. For firing, the bodies are fired in an atmosphere of about 890° C. for about 150 minutes. Finally, conductive paste primarily including silver is applied by immersion to the end surfaces where the lead electrodes 4*a* and 4*b* are exposed. After drying the bodies at about 100° C. for about 10 minutes, baking is performed at about 780° C. for about 150 minutes. In this manner, the laminated coil according to the first preferred embodiment is obtained.

TABLE 1

| | Rdc (mΩ) | Inductance (μH) |
|---|---|---|
| Conventional Example | 185 | 2.00 |
| First Embodiment | 166 | 1.91 |
| First Comparative Example | 150 | 1.56 |

Figure 3:
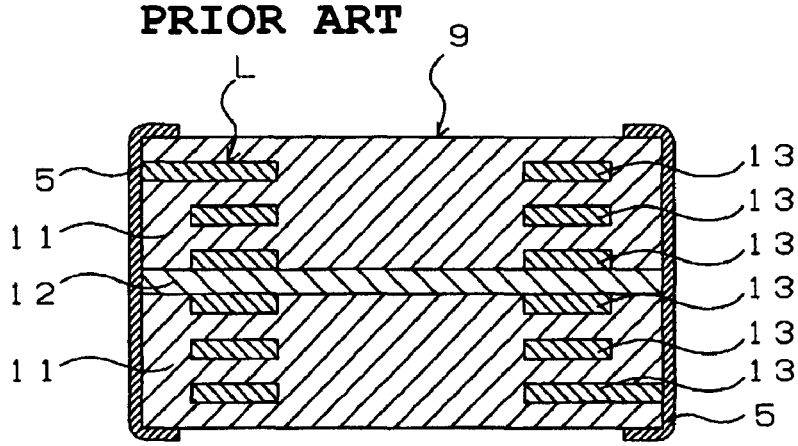
FIG. 3 PRIOR ART
FIG. 3 is a schematic cross-sectional view of a known laminated coil.
Figure 4:
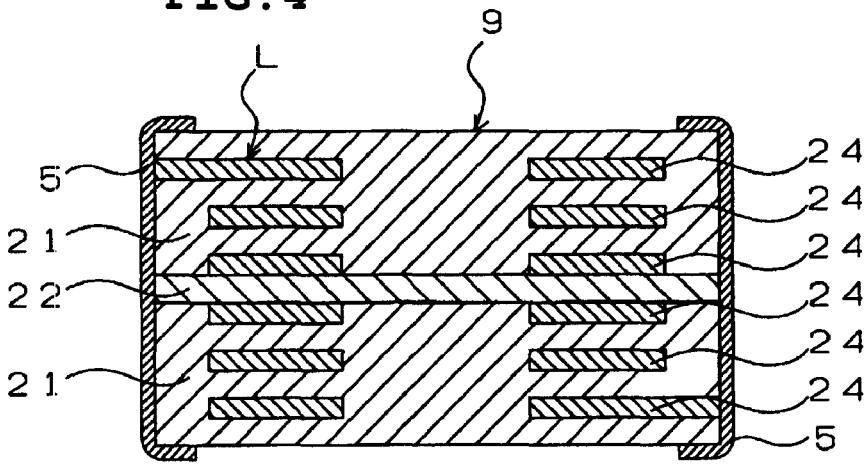
FIG. 4 is a schematic cross-sectional view of a laminated coil according to a first comparative example.

Table 1 shows the results of tests performed to confirm the advantages of the laminated coil according to the first preferred embodiment produced as described above. As shown in FIG. 3, in the laminated coil according to the conventional example, the conductor width of each of the coil conductors 13 provided on magnetic body sections 11 and a non-magnetic body section 12 is about 350 μm. As shown in FIG. 4, with the laminated coil according to the comparative example, each of the conductor width of coil conductors 24 provided on magnetic body sections 21 and a non-magnetic body section 22 is broader, about 550 μm. For every laminated coil, the number of coil turns of the helical coil L is about 5.5 turns, and the size of the laminated coil is 3.2×2.5×2.5 mm.

According to Table 1, for the laminated coil according to the first preferred embodiment, the direct current resistance is reduced and the reduction of inductance is relatively small. More specifically, the direct current resistance of the conventional example is about 185 mΩ, whereas the direct current resistance of the first preferred embodiment is about 166 mΩ and is reduced by about 10%. The inductance of the conventional example is about 2.0 μH, whereas the inductance of the first preferred embodiment is about 1.91 μh and is reduced by about 4.5%. In contrast, according to the comparative example in which the conductor width of all coil conductors is increased, the direct current resistance is reduced by about 18% to about 150 mΩ and the inductance is greatly reduced by about 22% to about 1.56 μH. In this manner, according to the first preferred embodiment, the reduction of inductance is suppressed while the direct current resistance is reduced by increasing the conductor width of the coil conductors 4 because the coil conductors 4 having an increased conductor width are provided on both main surfaces of the non-magnetic body section 2 blocking the magnetic flux.

TABLE 2

| | Conductor Width of Coil Conductors disposed on Both Main Surfaces of Non-magnetic Body | Conductor-Width Ratio between Coil Conductors disposed on Both Main Surfaces of Non-magnetic Body and those which are not disposed thereon | Rdc (mΩ) | Inductance |
|---|---|---|---|---|
| Conventional Example | 350 μm | 1.00 | 185 | 2.00 |
| Specimen 1 | 357 μm | 1.02 | 184 | 2.00 |
| Specimen 2 | 368 μm | 1.05 | 183 | 1.99 |

TABLE 2-continued

| | Conductor Width of Coil Conductors disposed on Both Main Surfaces of Non-magnetic Body | Conductor-Width Ratio between Coil Conductors disposed on Both Main Surfaces of Non-magnetic Body and those which are not disposed thereon | Rdc (mΩ) | Inductance |
|---|---|---|---|---|
| Specimen 3 | 450 μm | 1.29 | 176 | 1.96 |
| Specimen 4 | 550 μm | 1.57 | 166 | 1.91 |
| Specimen 5 | 650 μm | 1.86 | 157 | 1.86 |
| Specimen 6 | 750 μm | 2.14 | 147 | 1.79 |
| Specimen 7 | 850 μm | 2.43 | 138 | 1.71 |

Next, Table 2 shows the evaluation results of specimens 1 to 7, wherein the conductor widths of the coil conductors 4 provided on both main surfaces of the non-magnetic body section 2 are changed. The specimens 1 to 7 were produced such that the conductor widths of the coil conductors 4 provided on both main surfaces of the non-magnetic body section 2 differ and are about 357 μm, about 368 μm, about 450 μm, about 550 μm, about 650 μm, about 750, and about 850 μm, respectively. Meanwhile, the width of each conductor in the laminated coil according to the conventional example is the same, i.e., 350 μm, as shown in FIG. 3.

For the specimens 2 to 6, the direct current resistance is reduced and the inductance values are desirable. The specimen 1 (conductor width ratio of about 1.02) exhibited a significantly small reduction of less than about 1% in the direct current resistance. For the specimen 7 (conductor width ratio of about 2.43), reduction in the inductance value compared with that of the conventional example is significantly suppressed by about 14.5%.

Second Preferred Embodiment

Figure 8:
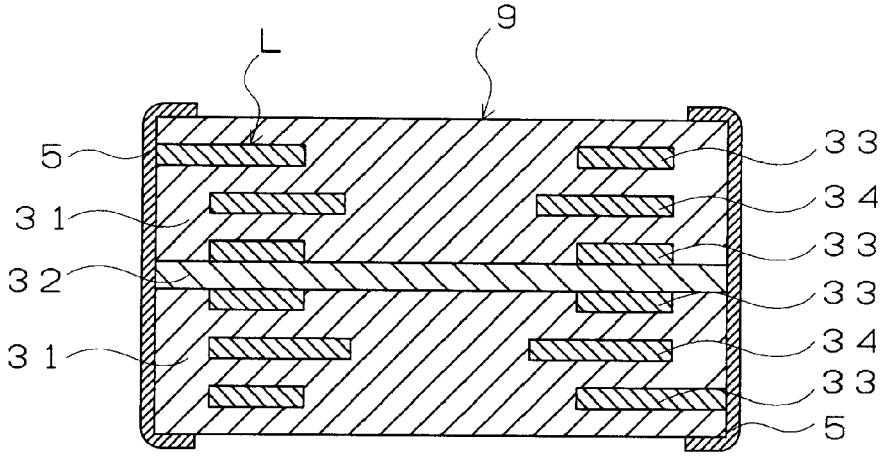
FIG. 8 is a schematic cross-sectional view of a laminated coil according to a second comparative example.

The structure of a laminated coil according to a second preferred embodiment of the present invention preferably is substantially the same as the structure of the laminated coil according to the first preferred embodiment illustrated in FIG. 1. However, for a laminated coil according to the second preferred embodiment, the conductor width of the coil conductors 4 disposed on both main surfaces of the non-magnetic body section 2 is about 750 μm, and the conductor width of the coil conductors 3 that are not disposed on both main surfaces of the non-magnetic body section 2 is about 350 μm. The conventional example shown in Table 3 below represents a laminated coil whose coil conductors 13 provided on magnetic body sections 11 and a non-magnetic body section 12 all have a conductor width of about 350 μm, as shown in FIG. 3. The second comparative example, as shown in FIG. 8, represents a laminated coil whose coil conductors 34 that are not provided on both main surfaces of a non-magnetic body section 32 (or, provided inside magnetic body sections 31) have a conductor width greater than that of other coil conductors 33. The conductor width of the coil conductors 34 having an increased conductor width is about 750 μm. The conductor width of the coil conductors 33 is about 350 μm.

TABLE 3

| | Rdc (mΩ) | Inductance (μH) |
|---|---|---|
| Conventional Example | 185 | 2.00 |
| Second Embodiment | 147 | 1.79 |
| Second Comparative Example | 147 | 1.53 |

For the laminated coil according to the second preferred embodiment, as shown in Table 3, the direct current resistance is reduced as compared to the conventional example because the conductor width of the coil conductors 4 that are disposed on both main surfaces of the non-magnetic body section 2 is increased. Furthermore, for the laminated coil according to the second comparative example, the direct current resistance is reduced as compared to the conventional example because the conductor width of the coil conductors 34, as many as the turn number of the laminated coil according to the second embodiment, is increased. The inductance of the laminated coil according to the second preferred embodiment is about 1.79 μh and is only reduced by about 10% as compared to the conventional example. The inductance of the laminated coil according to the second comparative example is about 1.53 μm and is reduced by about 23% as compared to the conventional example. The reduction of the inductance of the laminated coil according to the second preferred embodiment is suppressed because the coil conductors 4 having a greater conductor width are provided on both main surfaces of the non-magnetic body section 2 that blocks the magnetic flux.

Third Preferred Embodiment

Figure 5:
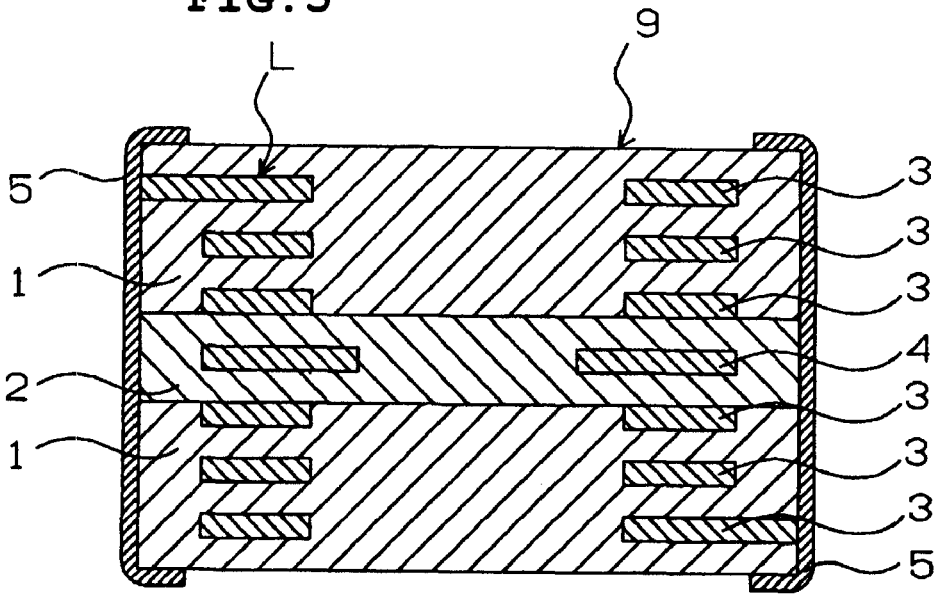
FIG. 5 is a schematic cross-sectional view of a laminated coil according to a third preferred embodiment of the present invention.

FIG. 5 illustrates a schematic cross-sectional view of a laminated coil according to a third preferred embodiment of the present invention. In FIG. 5, the components that are the same as or correspond to those in FIG. 1 are represented by the same reference numeral as those in FIG. 1, and descriptions thereof are not repeated.

In the laminated coil according to the third preferred embodiment, the coil conductors 4 are provided inside the non-magnetic body section 2. The conductor width of the coil conductors 4 is greater than the conductor width of the other coil conductors 3. Similar to the first preferred embodiment, the laminated coil according to the third preferred embodiment is produced through steps of stacking and pressure bonding green sheets having coil conductors, cutting the green sheets into chips, and forming external electrodes.

By providing the coil conductors 4 having an increased conductor width, the direct current resistance is reduced. Furthermore, by forming the coil conductors 4 having an increased conductor width inside the non-magnetic body section 2, the reduction of inductance is reduced.

Fourth Preferred Embodiment

Figure 6:
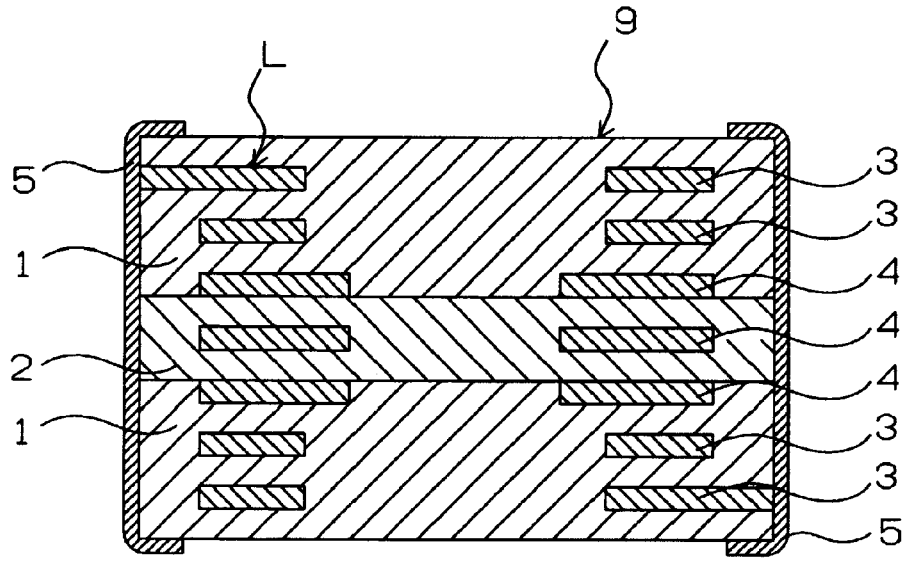
FIG. 6 is a schematic cross-sectional view of a laminated coil according to a fourth preferred embodiment of the present invention.

FIG. 6 illustrates a schematic cross-sectional view of a laminated coil according to a fourth preferred embodiment. In FIG. 6, the components that are the same as or correspond to those in FIG. 1 are represented by the same reference numeral as those in FIG. 1, and descriptions thereof are not repeated.

In the laminated coil according to the fourth preferred embodiment, the coil conductors 4 are provided inside the non-magnetic body section 2 and on both main surfaces of the non-magnetic body section 2. The conductor width of the coil conductors 4 is greater than the conductor width of the other coil conductors 3.

By providing the coil conductors 4 with an increased conductor width, the direct current resistance is reduced. In particular, according to the fourth preferred embodiment, since three layers of the coil conductors 4 having an increased conductor width are provided, the direct current resistance is significantly reduced. By forming the coil conductors 4 having an increased conductor width inside the non-magnetic body section 2 and on both main surfaces of the non-magnetic body section 2, the reduction of inductance is reduced.

Fifth Preferred Embodiment

Figure 7:
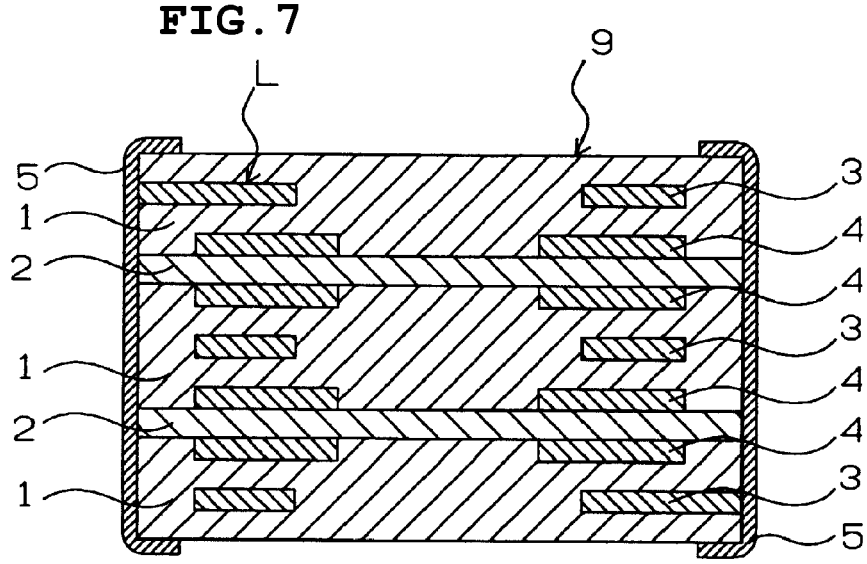
FIG. 7 is a schematic cross-sectional view of a laminated coil according to a fifth preferred embodiment of the present invention.

FIG. 7 illustrates a schematic cross-sectional view of a laminated coil according to a fifth preferred embodiment. In FIG. 7, the components that are the same as or correspond to those in FIG. 1 are represented by the same reference numeral as those in FIG. 1, and descriptions thereof are not repeated.

In the laminated coil according to the fifth preferred embodiment, two of the non-magnetic body sections 2 are provided inside the laminated body 9. The coil conductors 4 are provided on both sides of the non-magnetic body sections 2. The conductor width of the coil conductors 4 is greater than the conductor width of the other coil conductors 3.

Since two of the non-magnetic body sections 2 are provided inside the laminated body 9, the amount of magnetic flux leaking outside the laminated coil is increased, and the DC superposition characteristic is improved. By providing wide coil conductors 4, the direct current resistance is reduced. In particular, according to the fifth preferred embodiment, since four layers of the coil conductors 4 having an increased conductor width are provided, the direct current resistance is significantly reduced. By providing coil conductors 4 having an increased conductor width on both main surfaces of the non-magnetic body sections 2, the reduction of inductance is reduced.

The laminated coil according to preferred embodiments of the present invention is not limited to the above-described preferred embodiments, and various modifications may be made and still fall within the scope of the present invention.

For example, the conductor width of one of the coil conductors provided on both main surfaces of the non-magnetic body section may be increased. The conductor width of at least one of the coil conductors provided inside the non-magnetic body section and on both main surfaces of the non-magnetic body section may be greater than the conductor width of the other coil conductors in the main sections.

As described above, the present invention may be used for an open magnetic path type laminated coil and, in particular, is advantageous in that the DC superimposition characteristic is excellent, reduction in inductance is reduced, and direct current resistance is reduced.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A laminated coil comprising:

a laminated body including a non-magnetic body section and magnetic body sections provided on both main surfaces of the non-magnetic body section, the magnetic body sections including a plurality of stacked magnetic layers, the non-magnetic body section including at least one layer of a non-magnetic layer; and a coil including coil conductors provided in the laminated body, the coil conductors being helically connected; wherein at least one of the coil conductors is provided inside the non-magnetic body section or on each of the main surfaces of the non-magnetic body section;

at least one of the coil conductors is provided inside the magnetic body sections; and the conductor width of the at least one of the coil conductors provided inside the non-magnetic body section or on each of the main surfaces of the non-magnetic body section is greater than the conductor width of the at least one of the coil conductors provided inside the magnetic body sections.

2. The laminated coil according to claim 1, wherein the conductor width of the coil conductors having a greater conductor width is about 1.05 to about 2.14 times the conductor width of the other coil conductors provided in the laminated body.

3. The laminated coil according to claim 1, wherein a plurality of the non-magnetic body sections are provided inside the laminated body.

4. A laminated coil comprising:

a laminated body including at least one non-magnetic body section and magnetic body sections provided on both main surfaces of the at least one non-magnetic body section, the magnetic body sections include a plurality of stacked magnetic layers, the at least one non-magnetic body section including at least one layer of a non-magnetic layer; and a coil including coil conductors provided in the laminated body, the coil conductors being helically connected; wherein the at least one non-magnetic body section includes at least one of the coil conductors;

at least one of the coil conductors is provided inside the magnetic body sections; and the conductor width of the at least one of the coil conductors of the at least one non-magnetic body section is greater than the conductor width of the at least one of the coil conductors provided inside the magnetic body sections.

5. The laminated coil according to claim 4, wherein the at least one of the coil conductors of the at least one non-magnetic body section includes a coil conductor provided inside the non-magnetic body section.

6. The laminated coil according to claim 4, wherein the at least one of the coil conductors of the at least one non-magnetic body section includes coil conductors provided on both main surfaces of the non-magnetic body section.

7. The laminated coil according to claim 5, wherein the at least one of the coil conductors of the at least one non-magnetic body section includes coil conductors provided on both main surfaces of the non-magnetic body section.

8. The laminated coil according to claim 4, wherein the conductor width of the coil conductors having a greater conductor width is about 1.05 to about 2.14 times the conductor width of the other coil conductors provided in the laminated body.

9. The laminated coil according to claim 4, wherein the at least one non-magnetic body section includes a plurality of non-magnetic body sections provided in the laminated body.

10. The laminated coil according to claim 4, wherein the at least one non-magnetic body section include a plurality of layers of non-magnetic material.

11. The laminated coil according to claim 4, wherein the at least one non-magnetic body section includes only a single layer of non-magnetic material.

12. The laminated coil according to claim 11, wherein the at least one of the coil conductors of the at least one non-magnetic body section includes coil conductors provided on both main surfaces of the non-magnetic body section.

13. The laminated coil according to claim 12, wherein the at least one of the coil conductors of the at least one non-magnetic body section includes a coil conductor provided inside the non-magnetic body section.

14. The laminated coil according to claim 13, wherein the at least one of the coil conductors of the at least one non-magnetic body section includes coil conductors provided on both main surfaces of the non-magnetic body section.

* * * * *